US005103727A

United States Patent [19]

Greer

[11] Patent Number: 5,103,727

[45] Date of Patent: Apr. 14, 1992

[54] METER ROLL MOUNTING MEANS

[75] Inventor: Larry J. Greer, Chesterfield, Mo.

[73] Assignee: Allied Gear & Machine Company, St. Louis, Mo.

[21] Appl. No.: 753,406

[22] Filed: Aug. 30, 1991

[51] Int. Cl.[5] ..... B41F 31/00

[52] U.S. Cl. ..... 101/352; 101/148; 101/209; 100/168

[58] Field of Search ..... 101/148, 205, 206, 207, 101/348, 349, 350, 351, 352, 329, 330, 331, 216, 219, 208, 209; 100/155 R, 168; 160/323.1-326; 118/258, 262; 384/256

[56] References Cited

U.S. PATENT DOCUMENTS

| | | | |
|---|---|---|---|
| 1,909,326 | 5/1933 | Wheeler, Jr. | 101/329 |
| 3,364,849 | 1/1968 | Price | 101/329 |
| 3,731,624 | 5/1973 | Kaneko et al. | 101/352 |
| 4,414,899 | 11/1983 | Hill | 101/350 |
| 4,554,869 | 11/1985 | Ranno, Sr. | 101/352 |
| 4,760,789 | 8/1988 | Witczak | 100/168 |
| 4,942,815 | 7/1990 | Greer et al. | 101/352 |

*Primary Examiner*—Edgar S. Burr
*Assistant Examiner*—Christopher A. Bennett
*Attorney, Agent, or Firm*—Cohn, Powell & Hind

[57] ABSTRACT

This roll mounting assembly (10) for mounting a meter roll between opposed sideframes (12) includes a meter roll (20) and opposed mounting blocks (28) each receiving a journal end (22) of the meter roll (20). The mounting blocks (28) are pivotally mounted to associated sideframes (12) by retractable pivot pin assemblies (30) for swinging movement of the roll (20). Threadedly adjustable members (50) are pivotally mounted to the sideframes (12) and are engageable with the mounting blocks (28) to adjust the location of the mounting blocks (28), and therefore the meter roll (20), to swing the meter roll (20) into and out of engagement with an anilox roll (120).

4 Claims, 2 Drawing Sheets

FIG. 1.
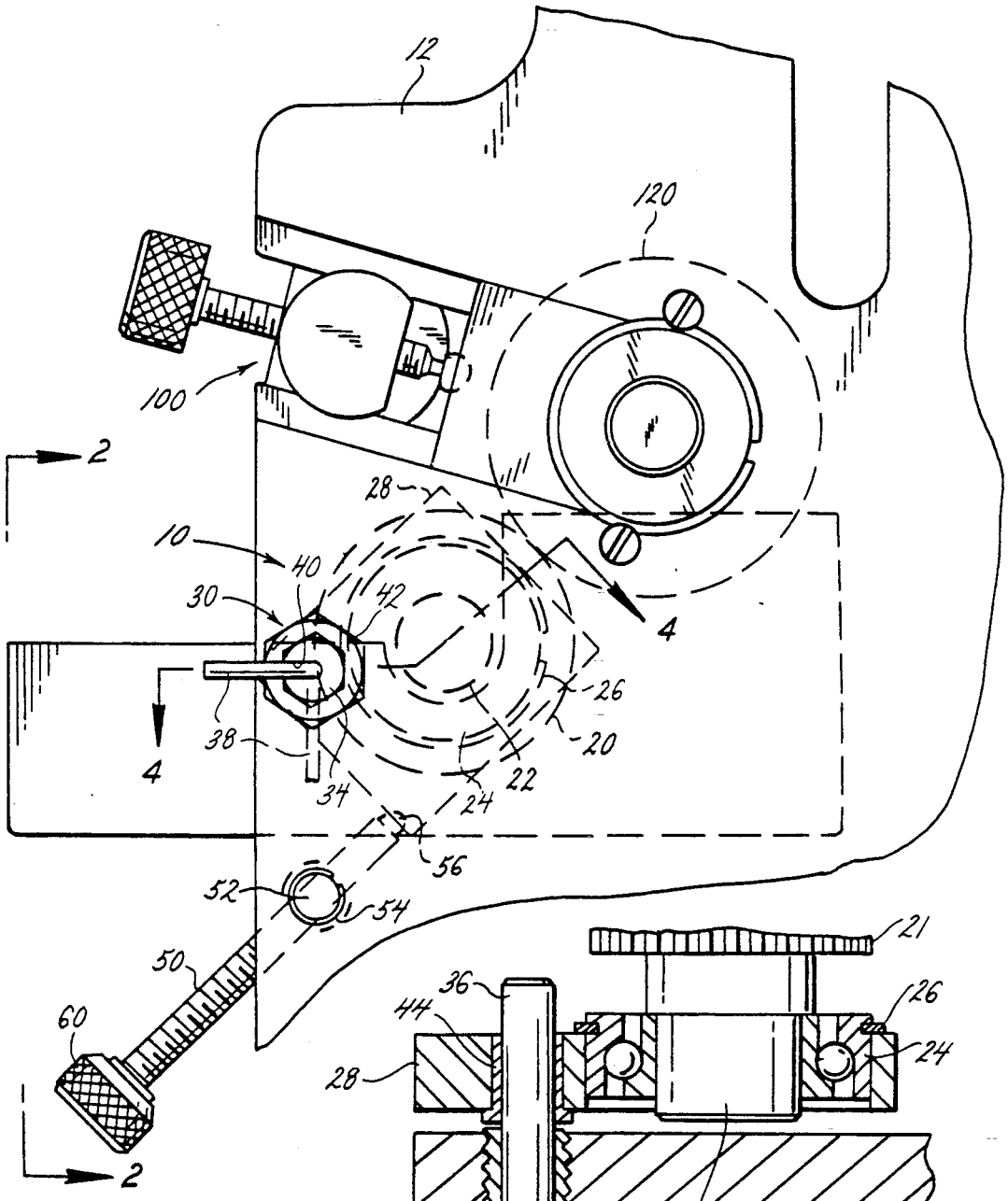
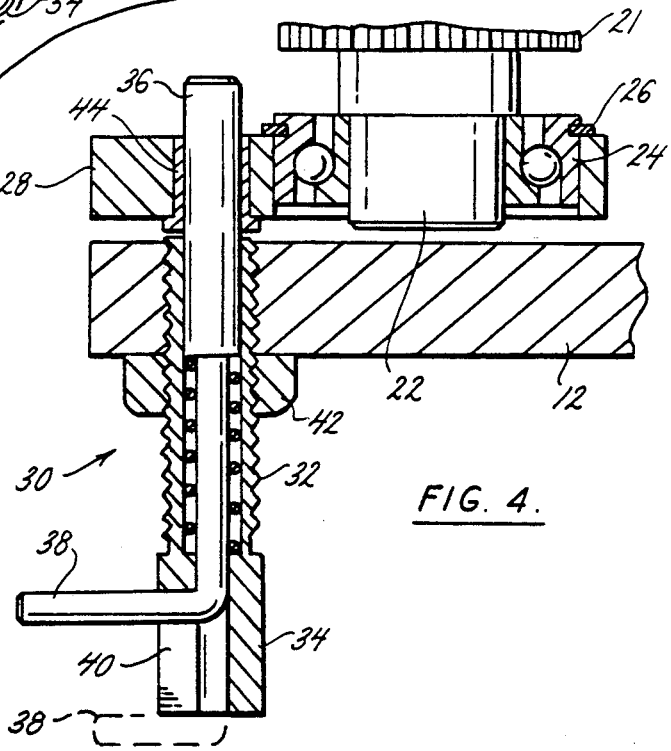
FIG. 4.

FIG. 2.
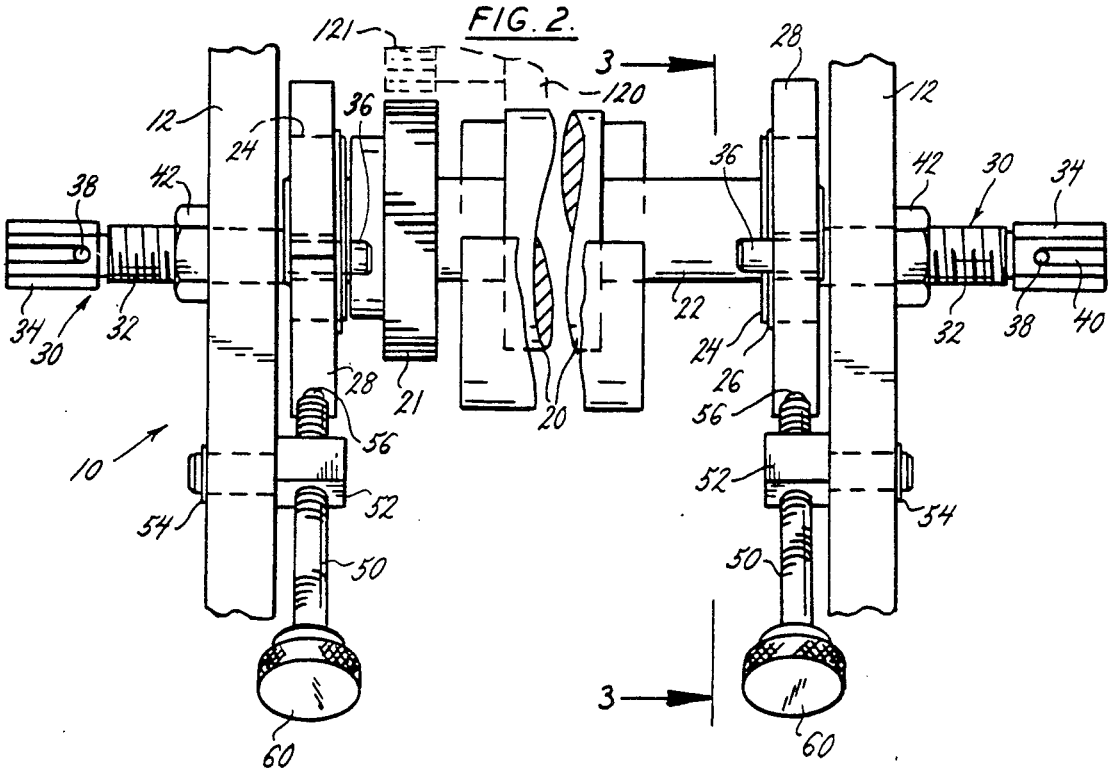
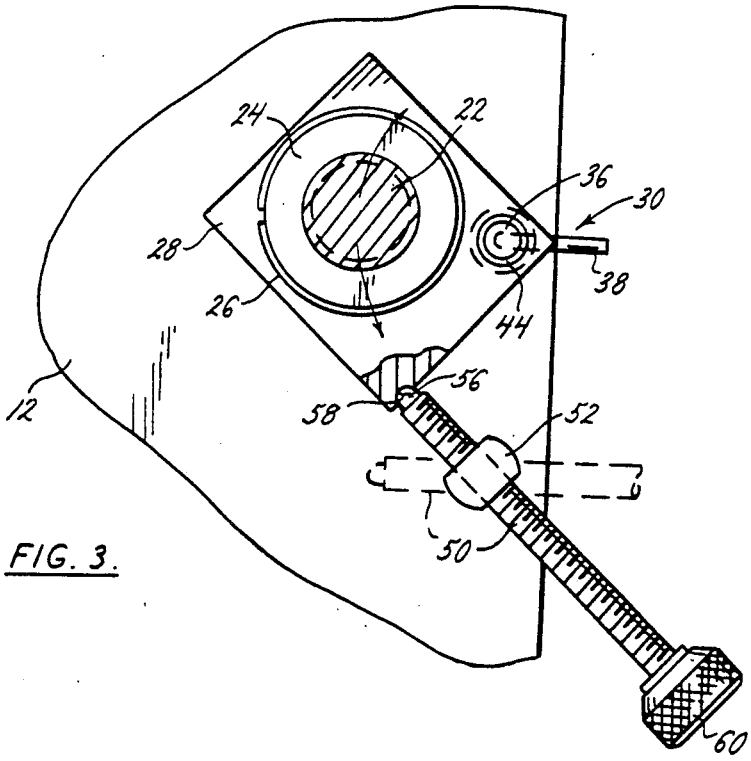
FIG. 3.

METER ROLL MOUNTING MEANS

BACKGROUND OF THE INVENTION

This invention relates generally to roll mounting means and particularly to a meter roll mounting means for a small, relatively low cost printing press.

Printing presses of the type under consideration which use a meter roll to transfer ink fluid from a supply reservoir to other rolls must make provision for easy removal of the roll for fluid change and roll cleanup.

Meter rolls must be easy to install, readily adjustable and easily removed for cleaning and access to other rolls especially the anilox or ink roll. With the larger presses there is justification in the expense of providing machined special end journals which are further attached to the printing mainframe. Usually, this is accomplished by fixed locating pins or shafts. In some instances cam latches are used, in others pneumatic locks.

In the prior art the closest reference is probably U.S. Pat. No. 4,942,815 assigned to the assignee hereof. This assembly works well for its intended purpose for use with a relatively large printing press but is not suitable for use with a relatively small and inexpensive printing press of the type for which there is a need in the industry and which, to be competitive must have much simpler and less expensive parts.

The present invention supplies these requirements in a manner not disclosed in the known prior art.

SUMMARY OF THE INVENTION

There has been a need in the printing industry for a relatively small, economical flexographic printing press. In order to fill this need the present invention is one of several companion inventions which simplify particular independent features of such a press namely: a printing press register adjustment means, a printing press support structure, a meter roll mounting means and an anilox roll mounting means. The meter roll mounting means, is disclosed herein, the other three features are disclosed in companion U.S. patent applications Ser. Nos. 753,071, 753,069 and 753,324, respectively, all filed Aug. 30, 1991, assigned to the assignee hereof and all incorporated herein by reference.

This invention provides a meter roll mounting means which is particularly suitable for use with a relatively small flexographic printing press and eliminates costly and cumbersome mounting assemblies.

This roll mounting assembly provides a secondary roll having opposed journal ends, opposed mounting block means each including bearing means receiving an associated journal end, opposed side support means at each end of said secondary roll, opposed retractable pivot pin means mounting said block means to said side support means in spaced relation from said axis of rotation of said secondary roll for swinging movement of said roll about said pivot pin means, said pivot pin means being movable between a retracted and an extended position to permit said roll to be removed from said side support means when said pin means are in the retracted position, said pin means being carried by either of said block means and side support means, and adjustment means for each mounting block including pivot means mounted to associated side support means in spaced relation from said axis of rotation of said secondary roll and an elongate adjustment screw carried by said pivot means and having a remote end engageable with said mounting block to adjust and control pivoting of said mounting block about said pivot pin means to swing said secondary roll about said pivot pin means toward and away from said primary roll.

It is an aspect of this invention to provide that each pivot pin means includes a hollow member connected to the support means and a spring-loaded pin carried by said member, said pin means including means engageable by the member to hold said pin in said retracted position.

It is another aspect of this invention to provide that each pivot pin means includes a hollow member threadedly connected to an associated side support means, and a spring-loaded pin carried by said member, said pin having a transversely bent arm, and said member having an outer face engageable by said bent arm to hold said pin in said retracted position, and said member having a slot receiving said bent arm to hold said pin in said extended position.

It is still another aspect of this invention to provide that each mounting block is generally rectangular having opposed corners, said pivot pin means are located in one said corner, and said other corner includes means engageable by the remote end of the adjustment screw.

An aspect of this invention is to provide a roll mounting means which is relatively inexpensive to manufacture, easy to assemble and highly effective in operation.

BRIEF DESCRIPTION OF THE DRAWING

FIG. 1 is an elevational view of a printing press sideframe showing a meter roll and an ink roll mounted thereto;

FIG. 2 is an end view taken on line 2—2 of FIG. 1;

FIG. 3 is a fragmentary view taken on line 3—3 of FIG. 2; and

FIG. 4 is a fragmentary sectional view of the retractable pivot pin taken on line 4—4 of FIG. 1.

DESCRIPTION OF THE PREFERRED EMBODIMENT

Referring now by reference numerals to the drawings, and first to FIGS. 1 and 2, it will be understood that a pair of opposed sideframes 12 are shown which provide support for a meter roll mounting assembly 10, the meter roll constituting a secondary roll, and an ink roll mounting assembly 100, the ink roll constituting a primary roll. The ink roll mounting assembly 100 is shown in detail in U.S. patent application Ser. No. 07/753,324 which is assigned to the assignee of this application and is incorporated herein by reference. The meter roll assembly 10 will now be described with reference to FIGS. 1–4.

The meter roll mounting assembly 10 is disposed above an ink tray T and includes a meter roll 20 having opposed reduced ends 22 provided with bearings 24 each held in place against lateral restraint by a snap ring 26 within a mounting block 28 apertured to receive said bearing. The meter roll 20 includes, as best shown in FIG. 3, the mounting blocks 28 are generally rectangular and are removably mounted to the sideframes 12 by spring-loaded pivot pin assemblies 30. The pivot pin assemblies or means 30 are, in the embodiment shown, hand-retractable spring plungers commercially available from Reid Tool Supply Co. of Muskegon, Mich. under the designation FR62. Each pin assembly 30, as best shown in FIG. 4, includes a threaded hollow member 32 having a slotted head 34, and a spring-loaded plunger 36 having a bent arm 38 at the outer end which is engageable with the outer face of the head 34 when the plunger 36 is retracted and is received in the slot 40 when the plunger 36 is extended. The hollow member 32 is held in position by a locknut 42.

In the extended position, each plunger 36 is received within a bushing 44 provided in the mounting block 28. This structural arrangement of parts, as clearly shown by the arrow in FIG. 3 permits the mounting block 28 carrying the meter roll 20 to swing about the pivot pin provided by the plunger 36 and, accordingly permits the meter roll 20 to be adjusted into and out of engagement with the anilox roll 120. In the embodiment shown the meter roll 20 includes a gear 21 which is inboard of the sideframes and is driven by an associated gear 121 mounted to the anilox roll 120.

The adjustment of the meter roll 20 is provided by an elongate adjustment member 50 which is threadedly connected to a pivot block 52 rotatably mounted to each sideframe 12 and held in place as by a snap ring 54. The adjustment member remote end 56 is engageable within a detent 58 provided at the corner of the mounting block adjacent the pivot assembly 30. By this arrangement the mounting block 28, and therefore the meter roll 20 can be adjusted simply by rotating the fixed head 60 of the individual adjustment members 50.

It is thought that the structural features and functional advantages of this meter roll mounting assembly 20 are fully understood but for completeness of disclosure the removal and replacement of the assembly will be briefly described.

The anilox roll 120 rotates about a fixed axis and is, in the printing press under consideration, driven by a lineshaft (not shown). It includes an inboard gear 121 which drives the meter roll assembly 20 through a corresponding gear 21. By virtue of the mounting means utilized herein, the meter roll 20 is removable as a unit including the mounting blocks 28, the end bearings 24, and the driven gear 21. Removal is accomplished by a single operator by first backing off the adjustable members 50 so that the meter roll 20 moves out of engagement with the anilox roll 120, it being understood that the location of the axis of the plunger 36 relative to the axis of the roll (20) urges the roll (20) in a counterclockwise direction (FIG. 3) under the action of gravity. The plungers 36 can then be retracted in turn and the pins twisted into the hold position in which the bent arms 38 engage the outer face of the slotted head 34. The meter roll 20 is held by the operator as the second plunger is retracted so that the entire unit can be pulled free, the adjustment members so being rotated out of the way as necessary. It will be observed that the overall distance between the journal ends of the meter roll 20 and that the overall distance between the ends of the bushings 44 is less than the face to face distance between the sideframes 12 which facilitates the removal operation. It will be understood that the removal of the meter roll 20 affords access to the anilox roll 120 and facilitates removal of said anilox roll. It will also be understood that replacement of the meter roll is accomplished by simply reversing the procedure described above. Further, while the pivot pin means has been shown connected to the side support means, it could also if necessary be connected, reversely, to the mounting block.

In view of the above it will be understood that various aspects and features of the invention are achieved and other advantageous results are attained. While a preferred embodiment of the invention has been shown and described, it will be clear to those skilled in the art that various modifications may be made without departure from the invention in its broader aspects.

I claim as my invention:

1. In a roll assembly, in which a primary roll is mounted for engagement by a secondary roll having an axis of rotation parallel to the axis of rotation of the primary roll, a secondary roll mounting assembly comprising:

(a) a secondary roll having opposed journal ends, (b) opposed mounting block means each including bearing means receiving an associated journal end, (c) opposed side support means at each end of said secondary roll, (d) opposed retractable pivot pin means mounting said block means to said side support means in spaced relation from said axis of rotation of said secondary roll for swinging movement of said roll about said pivot pin means, said pivot pin means being movable between a retracted and an extended position to permit said roll to be removed from said side support means when said pin means are in the retracted position, said pin means being carried by said side support means, and (e) adjustment means for each mounting block including pivot means mounted to associated side support means in spaced relation from said axis of rotation of said secondary roll and an elongate adjustment screw carried by said pivot means and having a remote end engageable with said mounting block to adjust and control pivoting of said mounting block about said pivot pin means to swing said secondary roll about said pivot pin means toward and away from said primary roll.

2. An assembly as defined in claim 1, in which:

(f) each pivot pin means includes a hollow member connected to the support means and a spring-loaded pin carried by said member, said pin means including means engageable by the member to hold said pin in said retracted position.

3. An assembly as defined in claim 1, in which:

(f) each pivot pin means includes a hollow member threadedly connected to an associated side support means, and a spring-loaded pin carried by said member, said pin having a transversely bent arm, and said member having an outer face engageable by said bent arm to hold said pin in said retracted position, and said member having a slot receiving said bent arm to hold said pin in said extended position.

4. A roll assembly as defined in claim 1, in which:

(f) each mounting block is generally rectangular having opposed corners, (g) said pivot pin means are located in one said corner, and (h) said other corner includes means engageable by the remote end of the adjustment screw.

* * * * *